United States Patent [19]

Dyck

[11] Patent Number: 4,897,045

[45] Date of Patent: Jan. 30, 1990

[54] WIRE-SEIZING CONNECTOR FOR CO-AXIAL CABLE

[76] Inventor: Arthur Dyck, Box 455, Abbotsford, British Columbia, Canada, V2S 5Z5

[21] Appl. No.: 207,705

[22] Filed: Jun. 16, 1988

Related U.S. Application Data

[63] Continuation-in-part of Ser. No. 107,340, Oct. 13, 1987, abandoned.

[51] Int. Cl.[4] ..... H01R 17/18

[52] U.S. Cl. ..... 439/578; 439/856; 439/729; 439/713

[58] Field of Search ..... 439/578–585, 439/675, 805, 807, 727–729, 713, 856–858

[56] References Cited

U.S. PATENT DOCUMENTS

| | | | |
|---|---|---|---|
| 2,988,727 | 6/1961 | Berndt | 339/273 |
| 2,995,388 | 8/1961 | Morello, Jr. et al. | 285/340 |
| 3,300,075 | 1/1967 | Benoit et al. | 339/253 |
| 3,349,166 | 10/1967 | Ziegler, Jr. | 174/88 |
| 3,350,680 | 10/1967 | Benoit et al. | 339/253 |
| 3,678,447 | 7/1972 | Ziegler, Jr. et al. | 339/177 |
| 3,725,853 | 4/1973 | McKeown et al. | 339/252 |
| 3,854,789 | 12/1974 | Kaplan | 439/584 |
| 3,858,156 | 12/1974 | Zarro | 339/32 |
| 3,891,297 | 6/1975 | Poliak et al. | 439/807 |
| 3,944,313 | 3/1976 | McKeown et al. | 339/75 |
| 3,999,418 | 12/1976 | Morell | 72/377 |
| 4,076,367 | 2/1978 | Avins | 339/177 |
| 4,249,790 | 2/1981 | Ito et al. | 339/177 |
| 4,270,324 | 6/1981 | Erickson | 339/15 |
| 4,346,958 | 8/1982 | Blanchard | 439/584 |
| 4,447,107 | 5/1984 | Major et al. | 439/584 |
| 4,453,796 | 6/1984 | Monroe | 339/177 |

FOREIGN PATENT DOCUMENTS

| | | | |
|---|---|---|---|
| 2425070 | 12/1975 | Fed. Rep. of Germany | 439/583 |
| 2827526 | 1/1980 | Fed. Rep. of Germany | 439/583 |

*Primary Examiner*—David Pirlot
*Attorney, Agent, or Firm*—Bruce A. Kaser

[57] ABSTRACT

A co-axial table connector includes a wire-seizing mechanism that includes a pair of spaced, wire-seizing elements. An outer end of each element is angled inwardly so that both outer ends converge symmetrically with respect to each other. A cam member slidably fits over the elements and has divergent surfaces which come into camming contact with the convergent ends. This forces the elements inwardly and causes them to grip the end of a co-axial wire.

12 Claims, 8 Drawing Sheets

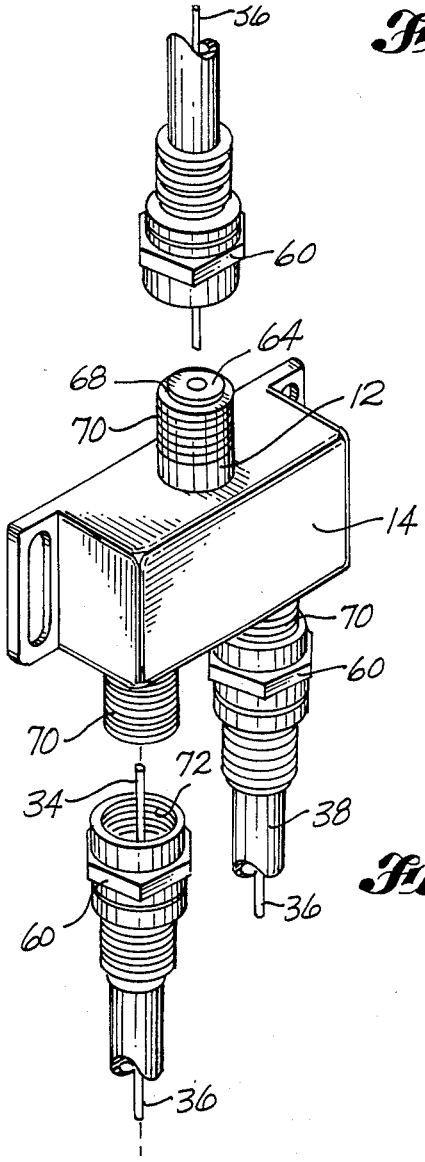
Fig. 12
Fig. 9
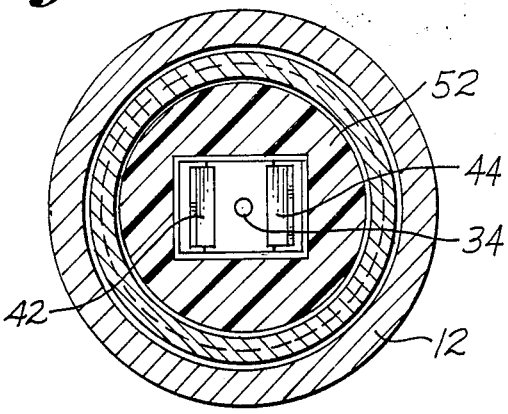
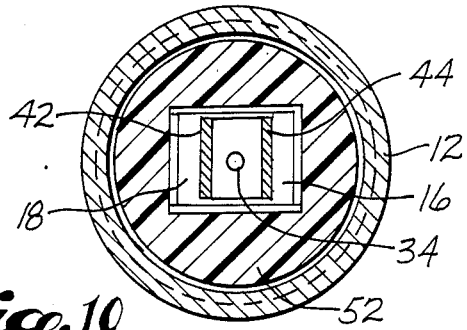
Fig. 10
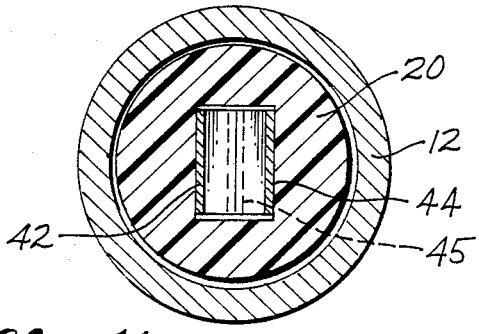
Fig. 11

WIRE-SEIZING CONNECTOR FOR CO-AXIAL CABLE

This application is a continuation-in-part of prior U.S. patent application Serial No. 107,340, file 10-13-87 which has been abandoned. TECHNICAL FIELD This invention relates to electrical connectors, and more specifically, to electrical connectors for co-axial cable that have a positive gripping action. BACKGROUND ART A co-axial cable is a signal transmitting wire or line, the construction of which would be familiar to a person skilled in the art. This type of cable usually consists of a central signal-conducting wire that is surrounded by a dielectric material. The dielectric material is further surrounded by a braided metal sheath, which is also a conductor, and the sheath is covered by an outer layer of insulation.

In the past, sections of co-axial cable have been connected together by a variety of devices including conventional threaded and twist-on couplings. A problem with couplings of this type is that they structurally connect one section of cable to another by attaching directly to and around the outer layer of insulation. None make the connection by attaching directly to the central wire. Of course, electrical contact between the wires is also made, but this is usually accomplished by a separate and relatively passive wire fitment into a female contact. The electrical contact can be easily pulled apart once the structural coupling, e.g. threaded, twist-on or the like, is disengaged.

U.S. Pat. Nos. 3,300,752 and 3,725,853 are pertinent to the present invention. The '752 patent, issued to G. Benoit et al. on Jan. 24, 1967, discloses an electrical plug-in type connector which has a movable and deformable metal socket. A plug is inserted into the socket and pushed axially into a housing, which also pushes the socket inwardly. During this movement, the socket has fillets made of a leaf spring material which cam against convergent surfaces in the housing. This causes the fillets to converge and grip the plug.

The '853 patent, issued to McKeown et al. on Apr. 3, 1973, discloses a "Y"-shaped, prong-type connector having laterally inwardly directed point contacts at each end of the Y's arms. The contact points are normally spaced from each other. A hole in a printed circuit board is placed between the contacts which are then caused to converge from opposite sides of the board and meet in the hole. Convergence is caused by translating the connector in one direction so that each connector arm is cammed against a separate roller bearing whose position does not change.

Neither of the above two patents disclose a connector that tightly grips an end length of a co-axial's central wire or center conductor. As will become apparent, an important difference between the present invention and the known prior art is that the present invention provides a connector that actively integrates both the structural and electrical connection of sections of co-axial. This is accomplished by making the connection at the same point: That is, by direct attachment to the co-axial's center conductor. DISCLOSURE OF THE INVENTION A wire-seizing connector constructed in accordance with the invention includes a pair of wire-seizing elements, each of which has an inner surface that opposingly faces the inner surface of the other. The elements are spaced from each other and the inner surfaces are normally substantially parallel when the wire-seizing elements are in a nonwire-seizing condition.

The elements' inner surfaces define an axial wire-receiving space in which the end of a co-axial wire is inserted. Suitable electrical contact elements are further provided in the space, one on each side of the wire, and are positioned immediately adjacent each inner surface of the seizing elements. The wire-seizing elements are movable laterally inwardly which closes the space and thus brings the contact elements into electrical contact against the wire. Not only does this create a good electrical contact, but it also firmly holds or grips the wire in place, thus making a good structural connection as well.

Closing the space is accomplished by a cam member that is moved axially against the outer axial ends of the wire-seizing elements. Each seizing element has an outer end surface at its outer end which is angled laterally inwardly. The angled end surfaces converge symmetrically with respect to each other. The cam member has a recess shaped to provide a male-female sliding fit or fitment over the elements' ends, and further, has a pair of inner wall surface portions in the recess which are shaped and positioned to slide in camming contact with the elements' angled or convergent end surfaces. The inner wall surface portions diverge symmetrically with respect to each other in a manner that complements the convergent surfaces. Axial movement of the cam member toward the wire-seizing elements causes the divergent surfaces to cam against the convergent surfaces. This, in turn, drives the wire-seizing elements inwardly and causes the above-mentioned wire-gripping action.

In what has been found to be a preferred embodiment of the invention, primarily because of its simplicity in construction, the wire-seizing elements are constructed of a single piece of elastically flexible dielectric material. Both elements extend axially outwardly from a body portion, so that their outer axial ends extend into the cam member's recess, with their opposite ends being homogeneously joined or molded from the same material as the body. When they are bent laterally inwardly by inward movement of the cam member, the above-mentioned convergent and divergent surfaces are angled in a manner so that the elasticity of the bent or flexed seizing elements produces an axially outwardly directed reactive force that acts at the point or place of contact between the convergent and divergent surfaces. This force opposes inward movement of the cam member, and further, when the cam member is released causes it to move axially outwardly, as the seizing elements return to a spaced apart condition.

As mentioned above, an advantage to the present invention is that it permits sections of co-axial to be structurally and electrically connected together by the same mechanism. An associated advantage is that when the co-axial is inserted into the space between the wire-seizing elements, it will not appreciably rub against the surfaces of the electrical contact elements, thereby scratching them and removing their surface plating. This is a common problem with previous connectors where the wire pushes contact elements apart as it is inserted. Preferably, the electrical contact elements are in the form of a separate electrically conductive spring contact member which has first and second elastically bendable metal leaves. Each leaf is positioned immediately inside the inner surface of each wire-seizing element. The seizing elements and leaves are laterally spaced apart a sufficient distance to accommodate insertion therebetween of a variety of sizes of co-axial. Although it is desired to eliminate over rubbing of the wire with the elements during insertion, it is generally preferred that the wire is subjected to a slight wiping action as it is inserted between the contacts provided by the leaves. In order to accommodate this, in the present invention the leaves may be narrowed for a small portion of their length near the outer axial ends of the seizing elements.

The invention was designed for use in connection with conventional threaded "F" port connector housings which, in the past, have been passive with respect to the electrical contact made with a co-axial's center conductor. Still a further advantage of the invention is that it provides an improved connector that has the capability of making an extremely strong combined electrical and physical contact without having inordinate structural complexity. For example, a connector constructed in accordance with the invention may be made of only three structural pieces. One piece would be the above-mentioned homogeneous body and wire-seizing elements; the second would be the spring contact member; and the third would be the cam member.

These pieces are shaped to be received in a tubular F port housing having an axial end opening. The cam member is shaped so that it has an outer end portion which extends axially outwardly through the housing's end opening. This portion has an outwardly facing surface against which a conventional nut member or nut thrusts as it is tightened onto the housing's threads, which drives the cam member inwardly. If the above-mentioned convergent and divergent angles are selected properly, there is no need for an additional axial spring to drive the cam member axially outwardly upon the nut's release.

The cam member is further made of an electrically insulative dielectric material, much like the seizing elements, so that there will be no electrical contact between the co-axial's center conductor and the housing or the nut.

Still a further advantage of the invention is that it provides a conductor where the area of contact between the center conductor and the electrical contacts is increased substantially.

These advantages, and others, will become apparent upon considering the drawings in conjunction with the following description.

BRIEF DESCRIPTION OF THE DRAWING

In the drawings, like reference numerals and letters refer to like parts throughout the various views, and wherein:

FIG. 9 is a cross-sectional view of the embodiment shown in FIGS. 6–8, and is taken along line 9—9 in FIG. 7;

FIG. 10 is a cross-sectional view of the embodiment shown in FIGS. 6–8, and is taken along line 10—10 in FIG. 7;

FIG. 11 is a cross-sectional view of the embodiment shown in FIGS. 6–8, and is taken along line 11—11 in FIG. 7;

FIG. 12 is a pictorial view of a conventional cable splitter, and shows a potential application for a connector constructed in accordance with the invention;

BEST MODE FOR CARRYING OUT THE INVENTION

Figure 1:
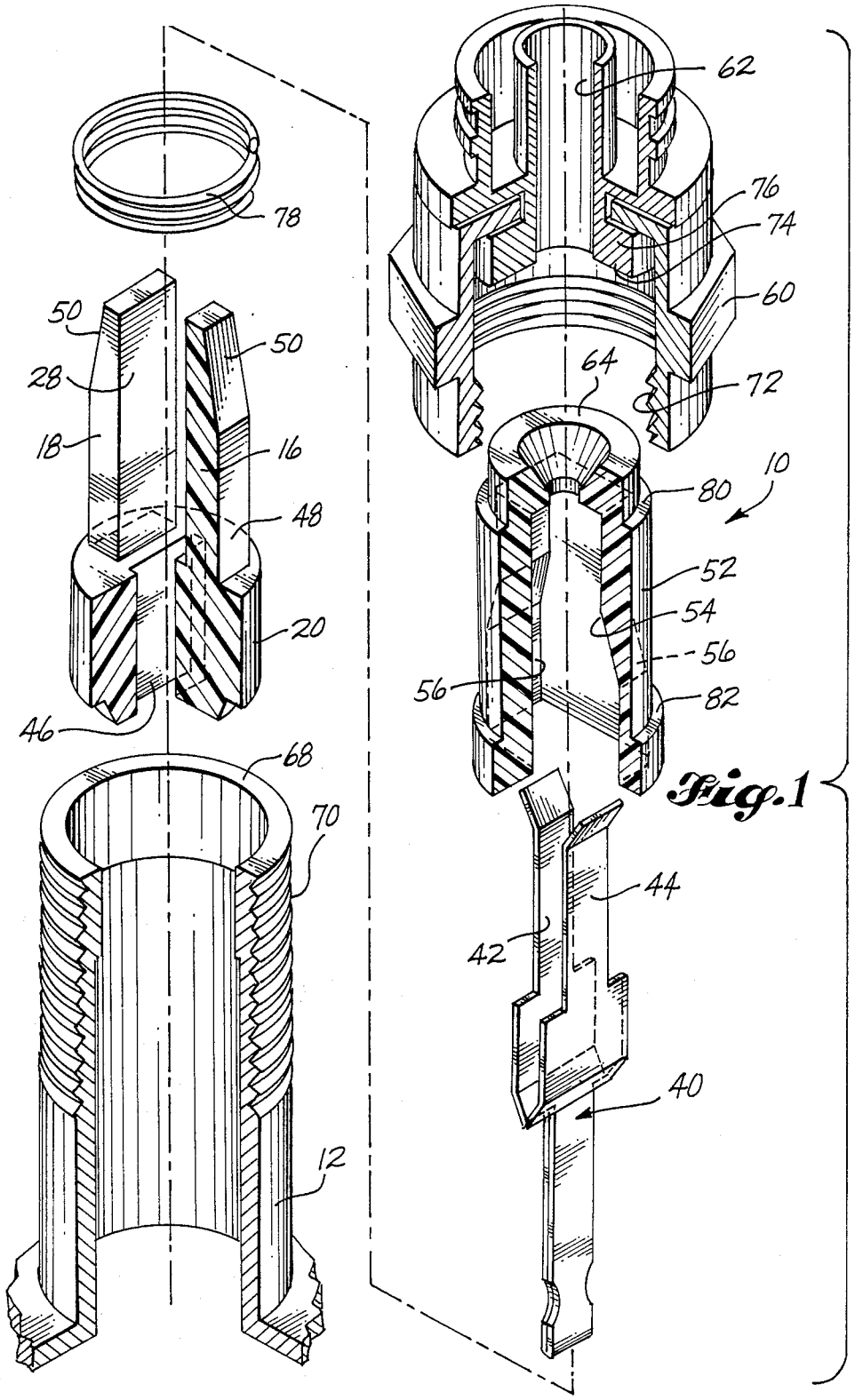
FIG. 1 is an exploded view of a wire-seizing co-axial connector constructed in accordance with one embodiment of the invention, and shows certain components of the connector in partial section.

Referring now to the drawings, and first to FIG. 1, therein is shown at 10 a co-axial connector constructed in accordance with the invention. The components making up the connector 10 are received in a hollow or tubular cylindrical housing 12. The housing 12 can be used as a portion of a conventional cable splitter 14 (see FIG. 12), which would be familiar to a person skilled in the art, or the connector 10 can be used to connect one co-axial section to another. This will be further discussed below.

Figure 2:
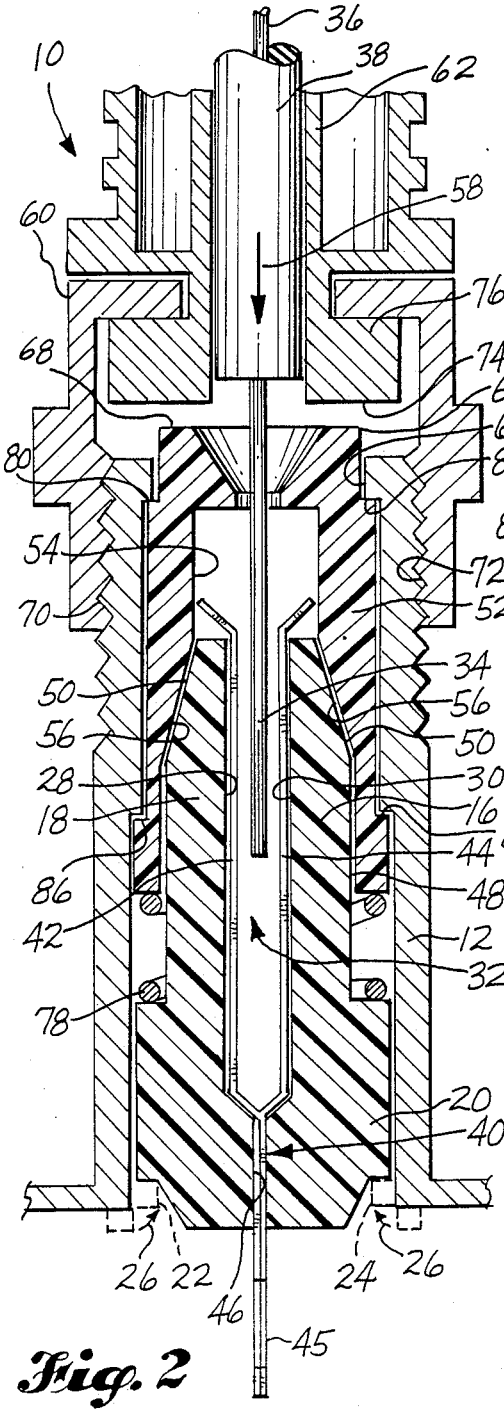
FIG. 2 is a side cross-sectional view of the connector shown in FIG. 1, but with the various components assembled, and shows the connector about to seize or grip the end of a co-axial wire.
Figure 3:
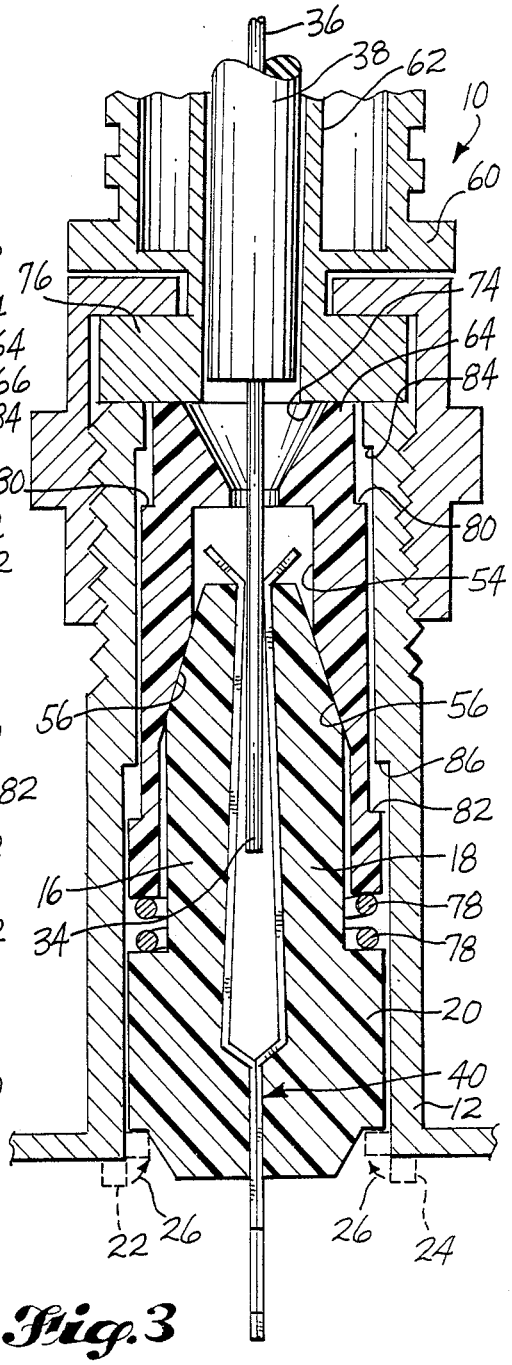
FIG. 3 is a view like FIG. 2, but shows the connector in operation to grip the wire.
Figure 5:
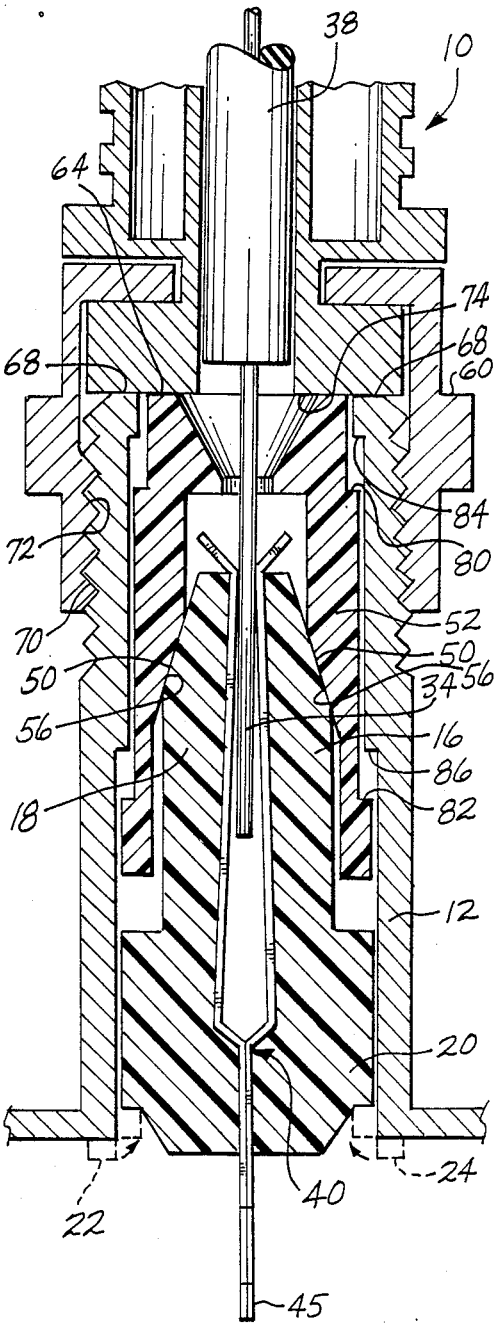
FIG. 5 is a view like FIG. 3, but for the embodiment shown in FIG. 4.
Figure 6:
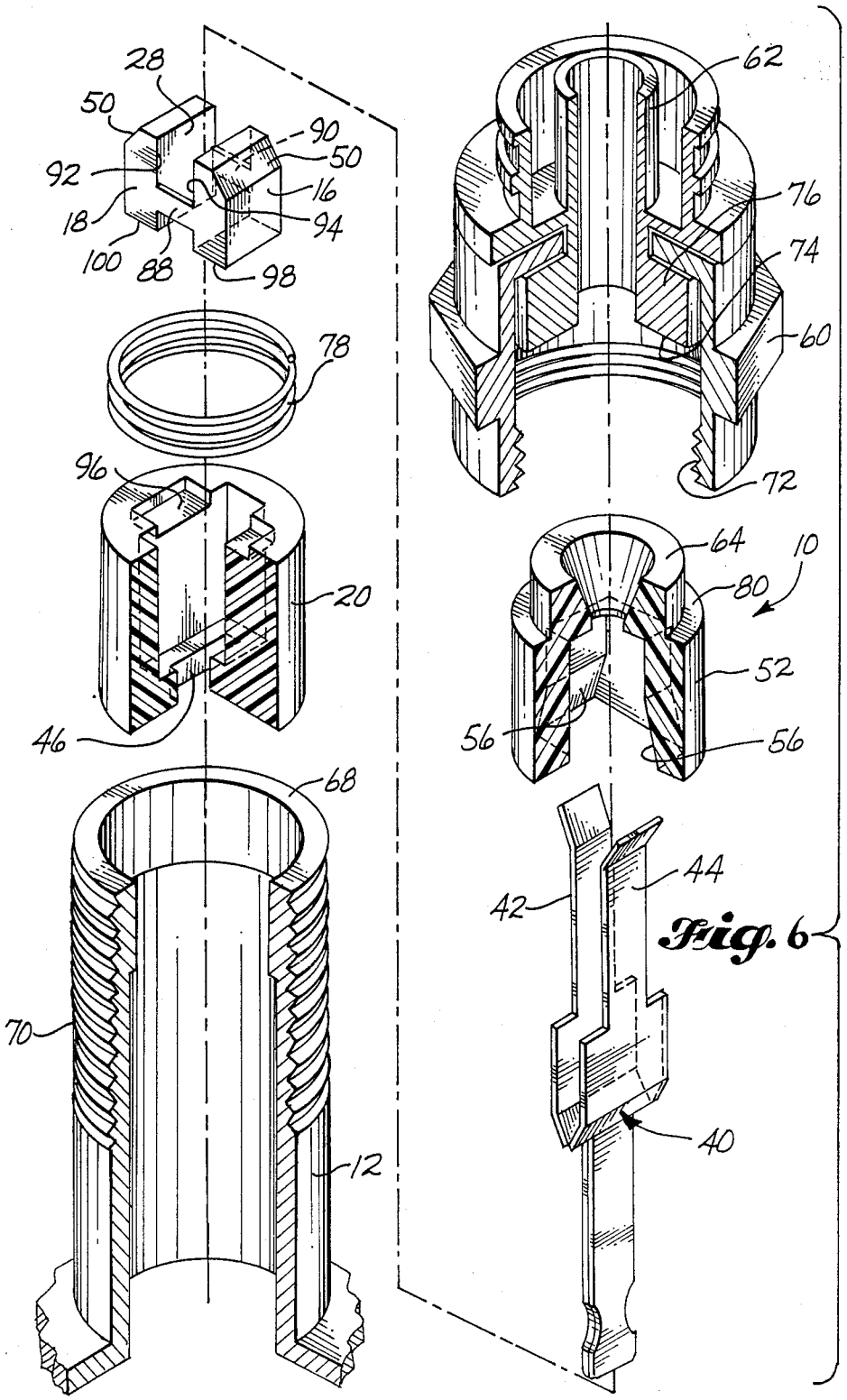
FIG. 6 is a view like FIG. 1, but shows still another embodiment.

Received in the housing 12 are a pair of wire-seizing elements 16, 18. Preferably, these elements 16, 18 project outwardly from a body or seating portion 20 made of the same material. For example, the elements and body 16, 18, 20 may be molded from a single piece of plastic so that both are structurally integrated together as a single unit. This is best shown in the side cross-sectional views provided in FIGS. 2 and 3. For reasons which will be explained later, the material should be sufficiently flexible to permit the elements to elastically bend or move laterally inwardly as shown in FIGS. 3 and 5.

The wire-seizing elements 16, 18 and body 20 are received in the housing 12 and held therein by tabs 22, 24. These tabs 22, 24 may be opened or bent over as indicated by arrows 26, to respectively position and hold the body and elements 20, 16, 18 in the housing 12. In preferred form, the housing 12 is metallic and may be designed for use as a "F" port connector housing, the utility of which would be familiar to a person skilled in the art.

Each wire-seizing element 16, 18 has an inner surface 28 that opposingly faces the inner surface 30 of the other. These surfaces 28, 30 define an elongated axial space 32 in which the end 34 of a co-axial wire 36 is inserted. The co-axial, indicated at 38, is of a conventional construction and would be familiar to a person skilled in the art.

Positioned immediately inside the elements 16, 18 is a "Y"-shaped female electrical contact 40 made of leaf spring material, or the like. The contact 40 has spaced electrical contact elements 42, 44, one each being positioned immediately adjacent a separate inner surface 28, 30 of the wire-seizing elements 16, 18. A base portion 45 of the contact 40 extends through an opening 46 in body 20. This portion 45 would be suitably connected to another conductor, which is not shown in the drawings. It should be appreciated, however, that this portion 45 could also be connected to another connector (not shown) like the connector 10 shown in FIG. 1, but with the other connector rotated 180° so that portion 45 is connected to a like portion of the other connector. As a person skilled in the art would appreciate, using the invention in this fashion would provide an apparatus that could be used to connect one co-axial to another.

Each wire-seizing element 16, 18 has an outer or outside surface 48, an end portion 50 of which is angled laterally inwardly. The angled ends 50 of each element converge symmetrically with respect to each other. Positioned over the elements 16, 18 is a cam member 52. This member 52 has an inner recess 54 shaped to permit the elements 16, 18 to be slidingly fitted thereinto. The recess 54 has divergent wall surface portions 56 which are shaped and positioned to cam against the wire-seizing elements' angled or convergent ends 50. When the cam member 52 is driven inwardly in the direction indicated by arrow 58, the divergent wall surface portions 56 are driven in camming contact with the angled ends 50, and thus drive each end and its corresponding seizing element laterally inwardly. This closes at least a portion of the space 32 between the elements 16, 18 and causes the electrical contact elements 42, 44 to grip the wire's end 34.

A threaded coupling or nut member 60 causes the cam member 52 to move or be thrust inwardly in female-male sliding fitment with the wire-seizing elements 16, 18. This coupling 60, which may be conventional in construction and already known to a person skilled in the art, has a sleeve opening 62 through which the co-axial 38 passes. If desired, the sleeve 62 may be crimped onto the co-axial in a conventional manner, although this is not necessary because the co-axial will be firmly held by the wire-seizing elements 16, 18.

An end portion 64 of the cam member 52 projects outwardly through an opening 66 in one end 68 of the housing 12. Positioned near this, on the housing's outer surface, is a conventional threaded portion 70. The nut member 60 has complimentary threads 72 on an inner surface portion thereof, which permits the nut member 60 to be placed over housing end 68 and screwed thereon. As this is done, a thrusting surface 74 of the nut member 60 abuts against the cam member's end portion 64 and pushes the cam member axially inwardly in the manner shown in FIGS. 3, 5 and 8. This further cams the seizing elements 16, 18 inwardly.

Preferably, that portion 76 of the nut member 60 which provides the thrusting surface 74 is made of metal and is in electrical contact with the braided sheath (not shown in the drawings) of the co-axial 38. The housing 12 is also made of metal so that when the nut member 60 is fully tightened, the thrusting surface 74 preferably contacts the housing. This provides a continuous secondary conductive path from the braided sheath, the importance of which would be known to a person skilled in the art.

When the nut member 60 is unscrewed, a spring 78 positioned between the seating body 20 and the cam member 52 pushes the cam member 52 outwardly. As divergent cam member surfaces 56 draw away from the wire-seizing elements' ends 50, the elasticity in the elements 16, 18 causes them to spread apart and open, which releases the wire's end 34. Further movement of the cam member 52 out of the housing 12 is prevented by outwardly projecting radial flange portions 80, 82 on the outer surface of the cam member, which abut against inwardly projecting radial portions 84, 86 of the housing 12.

Figure 4:
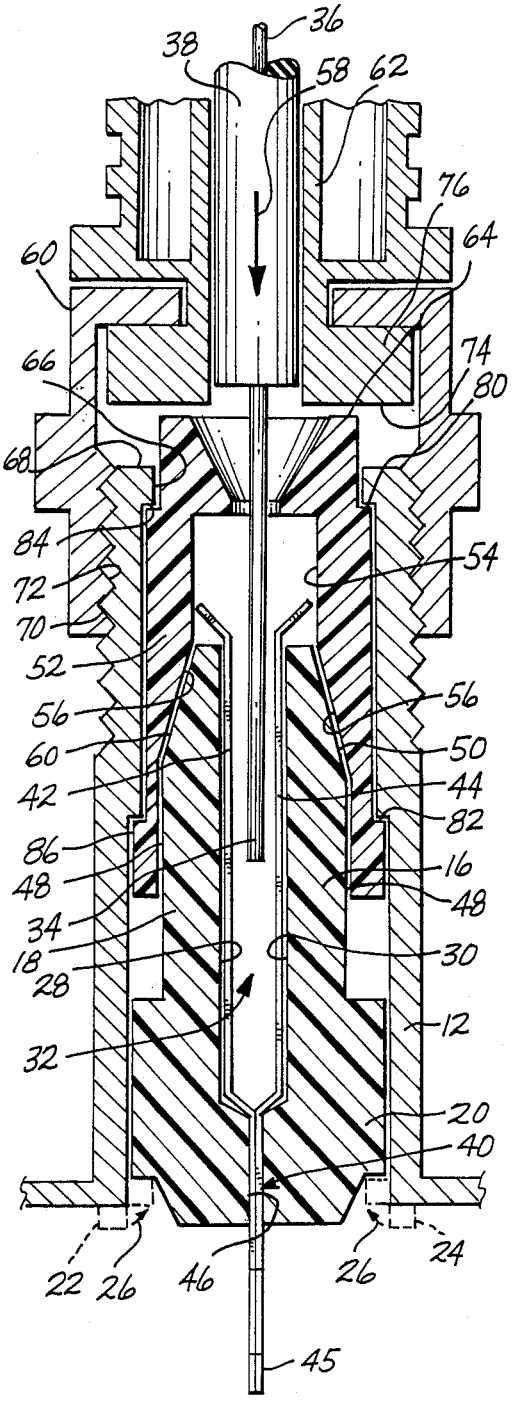
FIG. 4 is a view like FIG. 2, but shows another embodiment of the invention where a spring biased to move a cam member axially away from the connector's wire-seizing elements has been removed.

Referring now to FIGS. 4 and 5, therein is shown an alternative embodiment where the spring 78 has been removed. It is possible that the angles of convergent and divergent surfaces 50, 56 may be selected so that the natural elasticity of elements 16, 18 will reactively cause cam member 52 to move upwardly as nut member 60 is loosened. This may be an important advantage in that it eliminates one component of the connector 10 and therefore reduces its construction and assembly costs.

Figure 15:
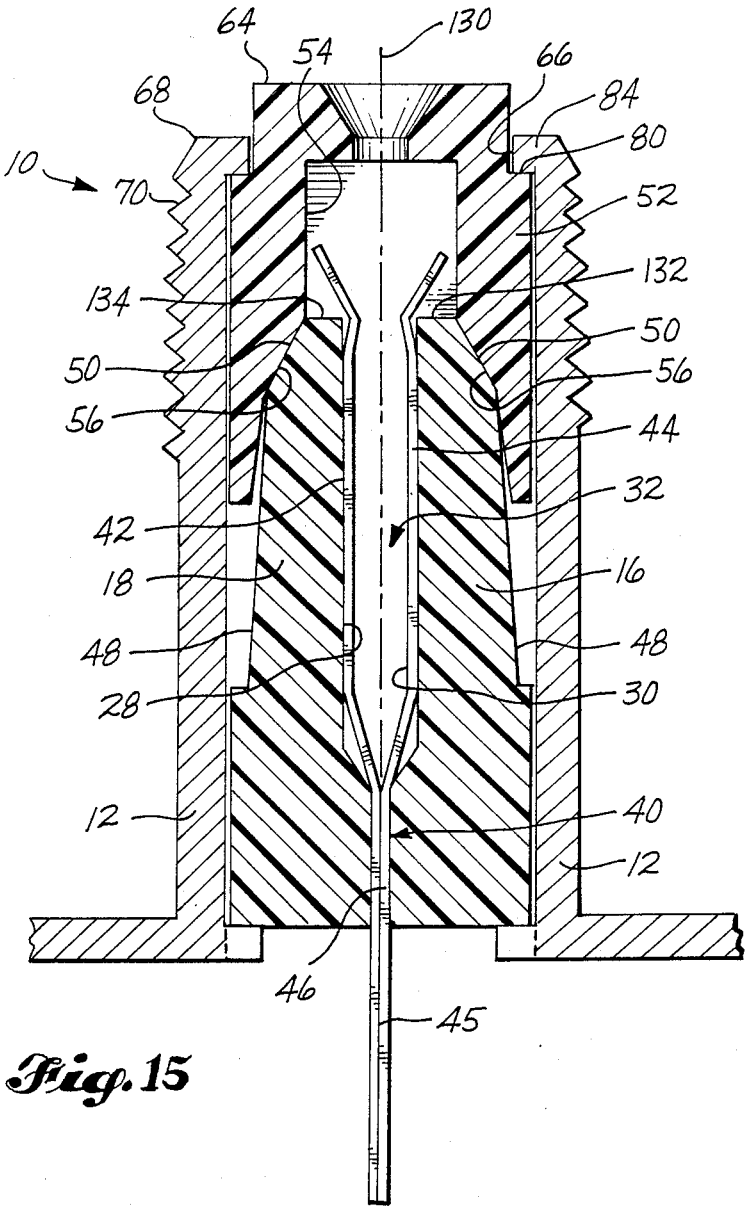
FIG. 15 is a view like FIG. 4, but shows a further embodiment of the invention where a normally spaced spring contact member is narrowed near the outer axial ends of the connector's seizing elements.

Referring to FIG. 15, therein is shown a further variation of the embodiments shown in FIGS. 4 and 5. This embodiment includes the same angled convergent outer end surfaces 50 on the seizing elements 16, 18, and divergent surfaces 56 on the cam member 52, but further has outer seizing element surfaces 48 which are angled slightly inwardly, primarily for ease of manufacture. The angles of convergent and divergent surfaces 50, 56 should be the same, and preferably, will be angled thirty degrees from their respective direction of convergence or divergence. More specifically, in FIG. 15, reference numeral 130 identifies a center-line axis for the connector 10 along which the cam member 52 moves axially inwardly and outwardly. It has been found that an orientation of thirty degrees for surfaces 50, 56 with respect to this axis 130 is optimal for causing seizing elements 16, 18 to exert a reactive axial force at the place of contact between surfaces 50, 56 when the elements are bent laterally.

It should be appreciated that after insertion of the center conductor 34 into space 32, as the cam member 52 moves inwardly it first closes the outer axial ends 132, 134 (see FIG. 15) of the seizing elements 16, 18. This, of course, also closes the metal leaves which make up contacts 42, 44. Further movement of the cam member causes further inward lateral bending of the seizing elements 16, 18 down their length so that the leaves 42, 44 also tightly press against the conductor along a substantial portion of their length. The resultant effect is an enhancement of electrical contact.

Still further, in the embodiment shown in FIG. 15 the leaves 42, 44, which are normally parallel along the inner surfaces 28, 30 of the seizing elements 16, 18, narrow a certain amount adjacent the element's outer axial ends 132, 134. The purpose of this is to permit the center conductor to wipe against this narrowed portion as it is inserted into space 32.

Figure 7:
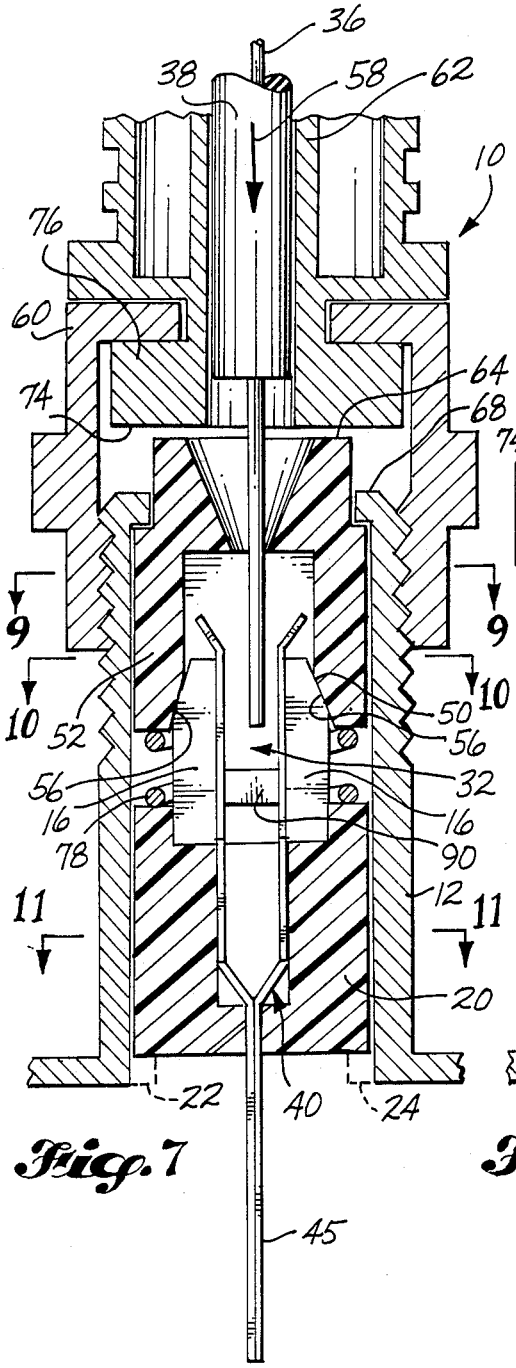
FIG. 7 is a view like FIGS. 2 and 4, but for the embodiment shown in FIG. 6.
Figure 8:
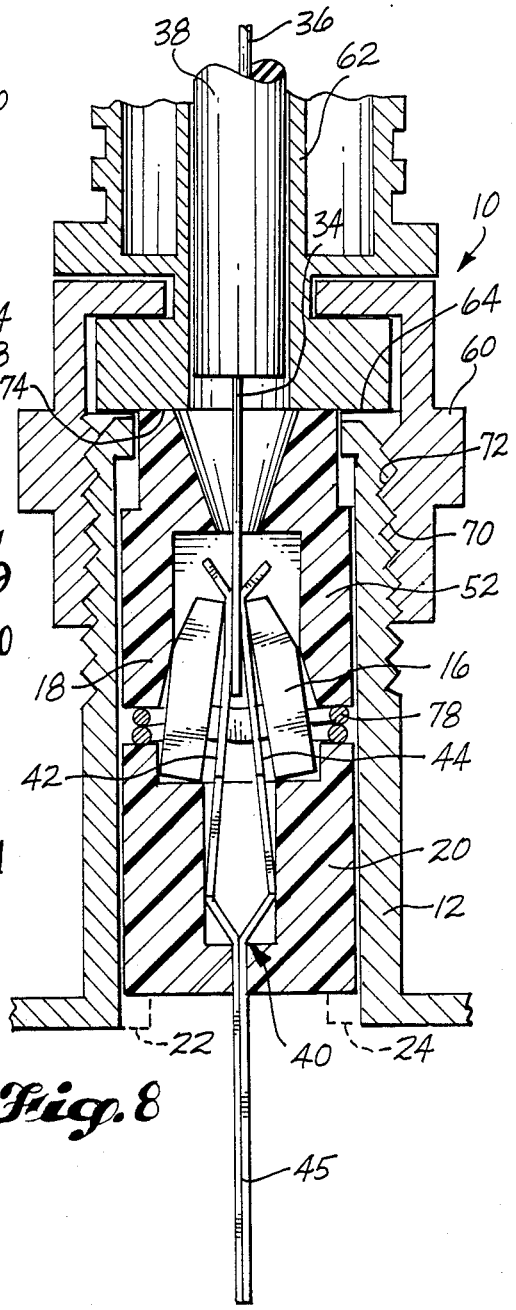
FIG. 8 is a view like FIGS. 3 and 5, but for the embodiment shown in FIG. 6.

Referring to FIGS. 7 and 8, therein is shown still another embodiment of the invention where the seizing elements 16, 18 are constructed separately from the body or seating portion 20. In this embodiment, elements 16, 18 are interconnected by a pair of laterally extending elastically flexible sections or elements 88, 90. These flexible elements have one end connected to an edge 92 of one of the wire-seizing elements' inner surfaces 28, and a second end connected to an opposing edge 94 of the other inner surface 30. The seating portion 20 has a recess 96 shaped to slidably receive or seat the wire-seizing elements' other ends 98, 100. When the cam member 52 is moved axially inwardly, in the above-described manner, flexible elements 88, 90 flex outwardly and permit the wire-seizing elements 16, 18 to be cammed inwardly as shown in FIG. 8. When the cam member 52 is released, the elasticity in elements 88, 90 causes the wire-seizing elements 16, 18 to move laterally outwardly.

Figure 13:
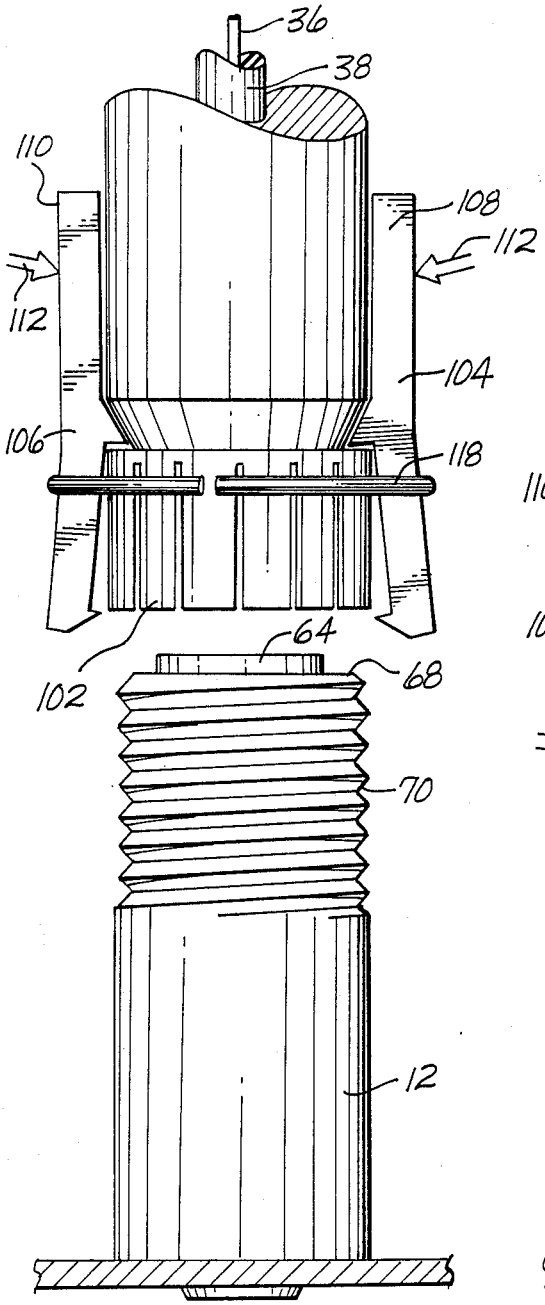
FIG. 13 is a side elevational view of an alternative coupling member that may be used to cause the invention to grip a wire, and shows the coupling member about to be connected over a threaded end portion of a connector housing.
Figure 14:
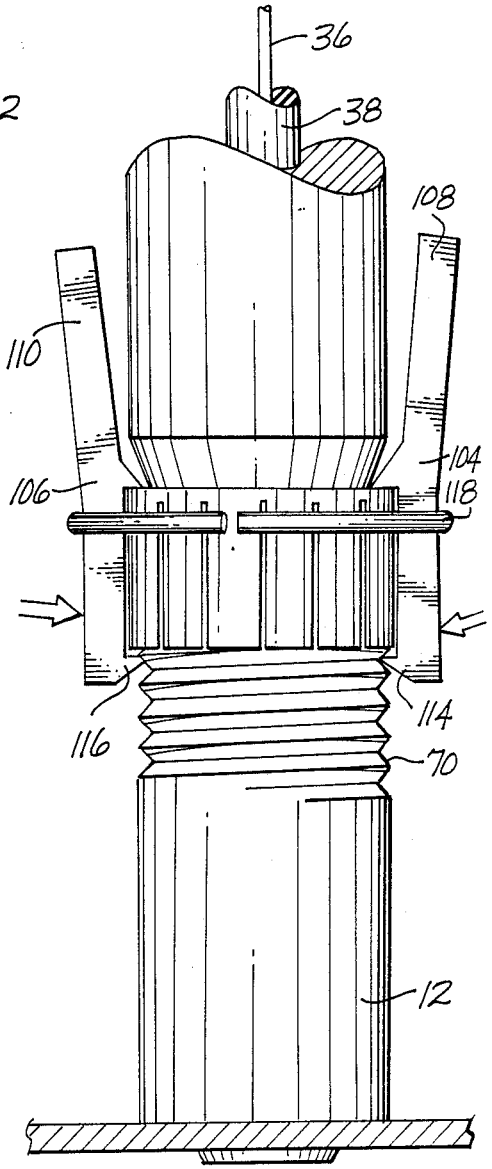
FIG. 14 is a view like FIG. 13, but shows the coupling member attached to the housing.

Directing attention now to FIGS. 13 and 14, therein is shown still another embodiment of the invention where the nut member 60 is replaced by a tubular socket 102. The socket 102 is shaped to fit over the end 68 of the housing 12 and is held in place by a pair of lateral arms 104, 106, each of which is pivotable. When the socket 102 is placed over the housing 12, the upper ends 108, 110 of the arms 104, 106 are squeezed inwardly as indicated by arrows 112. Then, when placement is finished, the arms 108, 110 are released which causes inwardly directed beads 114, 116 at the arms' lower end t catch the housing's threaded portion 70. An elastic ring 118 surrounds both the socket 110 and arms 104, 106 and is normally biased to hold the beaded portions 114, 116 inwardly.

Having thus described the best mode currently known for carrying out the invention, it should be appreciated the invention could be altered or modified without departing from the spirit and scope thereof. It should be appreciated that the applicant's legal rights are not to be limited by the above description, but rather are to be limited by the subjoined patent claims, the interpretation of which is to be made under the legally established doctrines of patent claim interpretation.

What is claimed is:

1. An "F" port connector, for making an electrical connection for a co-axial cable, comprising:

an electrically conductive housing, a portion of which defines a generally cylindrically shaped cavity, and having a radially inwardly projecting flange positioned at one end of said housing, said flange having a flat, axially outwardly facing annular surface which surrounds and defines an axial end opening leading into said cavity, said end opening having a diameter that is less than the inside diameter of said cavity;

an axially movable cam member made of an electrically insulative dielectric material, and having an inner portion received within said cavity, said inner portion having a smooth outer surface which is cylindrically shaped for sliding movement along the inner wall of said cavity, and an end portion defining one axial end of said cam member, said end portion having a smooth cylindrically shaped outer surface that extends through said housing end opening and normally projects axially outward past said annular surface of said flange, the outer diameter of said outer surface of said cam member's end portion being less than the outer diameter of said cam member's inner portion, said end portion providing an outwardly facing thrusting surface for driving said cam member axially inwardly into said cavity, and wherein the outer diameter of said smooth outer surface of said cam member's inner portion is greater than the width of said end opening in a manner so that said cam member's inner portion cannot pass through said end opening, said housing's flange retaining said inner portion in said cavity, said inner portion further having a camming recess facing axially inwardly;

a wire-seizing body also received in said housing and having a seating portion, and a pair of seizing elements extending axially away from said seating portion, with each seizing element having an outer axial end, each element end having an angled outer lateral surface, said angled surfaces converging symmetrically with respect to each other into said camming recess, and with said recess having at least a pair of divergent inner surfaces which drivingly contact said convergent angled surfaces as said cam member is driven axially into said cavity, said seizing elements being homogeneously joined to said seating portion in a manner such that said seating portion and said elements are formed from a single piece of material, and wherein said material is an electrically insulative dielectric material having sufficient elasticity to permit elastic lateral bending of said elements, said seizing elements being normally parallelly spaced from each other when in a nonwire-seizing condition along substantially their entire length from the location where they are joined to said seating portion to their outer axial ends, and further, each of said elements having a generally flat, rectangular inner surface, said inner surface of one element laterally facing said inner surface of one other; and an electrically conductive spring contact member having first and second normally spaced elastically bendable metal leaves, one leaf each substantially extending along the length of one of said inner surface of said seizing elements, said leaves being spread apart in a manner so as to define an axial wire-receiving space inbetween said seizing elements and said leaves, and wherein said divergent inner surfaces of said cam member drivingly contact said convergent angled surfaces of said seizing element's outer axial ends as said cam member moves axially into said cavity, in a manner so as to elastically bend said seizing elements laterally inwardly toward each other along their length from their ends toward the location where they are joined to said seating portion, said inner surfaces of said elements correspondingly driving said leaves laterally inwardly along said wire-seizing space from said element ends toward said seating portion to close upon a length of wire in said space.

2. The mechanism of claim 1, wherein said metal leaves are generally parallelly spaced between said seizing elements' inner lateral surfaces when said seizing elements are in a nonwire-seizing condition, but while in such condition the spacing of said leaves narrows near the axial outer ends of said seizing elements, to reduce the distance between said leaves so that a wire being inserted therebetween will rub against said leaves where they are narrowed, to create an electrical contact wiping action.

3. The mechanism of claim 1, wherein an end portion of each leaf extends outwardly past the outer axial end of the seizing element which is adjacent said leaf, said leaf end portions diverging with respect to each other into said camming recess, to define a guideway leading into said wire-receiving space.

4. A wire-seizing mechanism for use in making an electrical connection for a co-axial cable, comprising:

a housing defining a tubular cavity, and having an axial end opening;

an axially movable cam member having at least a portion received within said cavity, said portion having a camming recess that opens axially inwardly into said cavity;

a wire-seizing body also received in said housing, and having a seating portion and a pair of first and second elongated seizing elements extending axially through said cavity away from said seating portion, each element having an axial outer end extending into said camming recess, said seizing elements being homogeneously joined to said seating portion in a manner so that said seating portion and said elements are formed from a single piece of material, wherein said material has sufficient elasticity to permit elastic lateral bending of said seizing elements, and wherein said seizing elements each have a generally flat, rectangular inner lateral surface, said inner surface of one element laterally facing said inner surface of the other, said inner surfaces being normally parallel and spaced with respect to each other when said mechanism is in a nonwire-seizing condition, to define a wire-receiving space therebetween which leads into said camming recess, and with said inner lateral surfaces each terminating at the axial outer end of each seizing element; and an electrically conductive spring contact member having first and second laterally spaced, elastically bendable metal leaves positioned between said seizing elements, one leaf each extending adjacent one of said inner lateral surfaces of said seizing elements, in a manner so that said wire-receiving space is positioned between said leaves, the spacing of said seizing elements and said leaves defining the width of said wire-receiving space, and wherein such spacing is sufficiently wide so that said space may receive a wire having a diameter within a range of diameters, said leaves gripping and making electrical contact with said wire in response to inner lateral bending of said seizing elements.

5. The mechanism of claim 4, wherein each leaf has an end portion of each leaf extends outwardly past the outer axial end of the seizing element which is adjacent said leaf, said leaf end portions diverging with respect to each other into said camming recess, to define a guideway leading into said wire-receiving space.

6. The mechanism of claim 4, wherein said metal leaves are generally parallelly spaced between said seizing elements' inner lateral surfaces when said seizing elements are in a nonwire-seizing condition, but while in such condition the spacing of said leaves narrows near the axial outer ends of said seizing elements, to reduce the distance between said leaves so that a wire being inserted therebetween will rub against said leaves where they are narrowed, to create an electrical contact wiping action.

7. The mechanism of claim 6, wherein an end portion of each leaf extends outwardly past the outer axial end of the seizing element which is adjacent said leaf, said leaf end portions diverging with respect to each other into said camming recess, to define a guideway leading into said wire-receiving space.

8. A wire-seizing mechanism for use in making an electrical connection, comprising:

a pair of normally spaced wire-seizing elements, said elements each having an inner surface, and wherein said inner surfaces opposingly face each other and are substantially parallel when said mechanism is in a nonwire-seizing condition, and including means for providing an electrical contact immediately adjacent each inner surface, wherein said inner surfaces define an elongated axial wire-receiving space therebetween and between said electrical contact means, said wire-seizing elements each further having an outer surface, one end of which is angled laterally inwardly, said angled ends converging symmetrically with respect to each other, and said wire-seizing elements being movable laterally inwardly with respect to each other in a manner that causes narrowing of at least a portion of said axial space, for seizing a wire extending therein, and for placing said contact means in electrical contact with said wire;

an axially movable cam member having a recess shaped for male-female sliding fitment with said wire-seizing elements, said recess having first and second inner wall surface portions which diverge symmetrically with respect to each other, and which are shaped and positioned to slide in camming contact with said convergent angled ends of said wire-seizing elements when said cam member is axially moved towards said wire-seizing elements; and means for axially moving said cam member towards said wire-seizing elements, and for holding said cam member towards said wire-seizing elements, and for holding said cam member in a certain camming position, to drive said divergent wall surface portions of said cam member against said convergent ends of said wire-seizing elements, thereby causing said elements to move laterally inwardly to seize said wire; and elastic means biased to opposed lateral inward movement of said wire-seizing elements, wherein said elastic means includes first and second laterally extending elastically flexible elements, each of said flexible elements having a first end connected to an edge of one of said inner surfaces of said wire-seizing elements, and a second end connected to an opposing edge of the other of said inner surfaces, wherein said flexible elements are spaced from each other with each being normally flexible outwardly with respect to the other and said axial space, in a manner so that lateral inward movement of said wire-seizing elements causes said flexible elements to flex outwardly.

9. The mechanism of claim 8, wherein each of said wire-seizing elements has another end opposite said angled end, and including a seating member positioned adjacent said other ends, said seating member having a recess that is shaped in a manner so as to permit slidable fitment of said other ends thereinto, and including a spring operatively positioned between said cam member and said spring member to normally push said cam member away from said seating member and said wire-seizing elements.

10. A wire-seizing mechanism for use in an "F" port connector to make an electrical connection with a center conductor of a co-axial cable, comprising:

a tubular housing;

an axially movable cam member having at least a portion received within said housing, said portion having a camming recess;

a wire-seizing body also received in said housing, and having a seating portion and a pair of elongated seizing elements joined to and extending axially away from said seating portion, each element having an end extending into said camming recess and a laterally inwardly facing surface, said laterally inwardly facing surfaces being normally substantially parallelly spaced from each other when said mechanism is in a nonwire-seizing condition; and contact means, extending substantially adjacent each of said laterally inwardly facing surfaces, for providing an electrical contact with said center conductor; and wherein said seizing element ends and said camming recess are shaped in a manner so that said camming recess drivingly contacts said element ends and drives them laterally inwardly in response to axial movement of said cam member toward said wire-seizing body, until a portion of said contacts means contacts said center conductor at a certain location adjacent said element ends, said location defining a fulcrum point, and said camming recess drivingly contacts said ends at a position axially inwardly of said fulcrum point in response to continuing axial movement of said cam member toward said wire-seizing body, in a manner so as to create a lateral bending moment in said seizing elements that causes said laterally inwardly facing surfaces thereof to drive said contact means into electrical contact with and to seize a certain length of said center conductor inwardly of said fulcrum point.

11. The mechanism of claim 10, wherein said contact means includes first and second metal leaves positioned between said seizing elements' inner lateral surfaces, said metal leaves being generally parallelly spaced from each other when said seizing elements are in a nonwire-seizing condition, but while in such condition the spacing of said leaves narrows near the ends of said seizing elements, to reduce the distance between said leaves so that a wire being inserted therebetween will rub against said leaves where they are narrowed, to create an electrical contact wiping action.

12. The mechanism of claim 10, wherein said contact means includes first and second metal leaves, each leaf having an end portion extending outwardly past the ends of said seizing elements, said leaf end portions diverging with respect to each other and defining a guideway leading in between said metal leaves.

* * * * *

UNITED STATES PATENT AND TRADEMARK OFFICE

CERTIFICATE OF CORRECTION

PATENT NO. : 4,897,045

DATED : January 30, 1990

INVENTOR(S) : Arthur Dyck

It is certified that error appears in the above-identified patent and that said Letters Patent is hereby corrected as shown below:

In the Abstract, the first line, "table" should be -- cable --.

On the cover under "U.S. PATENT DOCUMENTS", the patent number for Benoit et al. should be -- 3,300,752 1/1967 Benoit et al. "

Col. 1, line 6, "file" should be -- filed --.

Col. 1, line 7, "TECHNICAL FIELD" is a heading and should be centered on the next line.

Col. 1, lines 10 and 11, "BACKGROUND ART" is a heading and should be centered on a separate line.

Col. 1, lines 63 and 64, "DISCLOSURE OF THE INVENTION" is a heading and should be centered on a separate line.

Col. 5, line 57, "complimentary" should be -- complementary --.

Col. 7. line 26, "t" should be -- to --.

UNITED STATES PATENT AND TRADEMARK OFFICE

CERTIFICATE OF CORRECTION

PATENT NO. : 4,897,045

DATED : January 30, 1990

INVENTOR(S) : Arthur Dyck

It is certified that error appears in the above-identified patent and that said Letters Patent is hereby corrected as shown below:

Claim 1, col. 7, line 61, "outward" should be -- outwardly --.

Claim 1, col. 8, line 38, "surface" should be -- surfaces --.

Claim 5, col. 9, line 48, delete "of each leaf", and insert -- that --.

Claim 9, col. 10, line 62, "spring" should be -- seating --.

Claim 10, col. 11, line 22, "contacts" should be -- contact --.

Signed and Sealed this

Ninth Day of April, 1991

*Attest:*

*Attesting Officer*

HARRY F. MANBECK, JR.

*Commissioner of Patents and Trademarks*